United States Patent [19]

Geens et al.

[11] Patent Number: 4,461,683

[45] Date of Patent: Jul. 24, 1984

[54] METHOD FOR SEPARATING IODINE IN SOLID FORM, FROM AN ACID MERCURY SALT SOLUTION

[75] Inventors: Ludo P. M. Geens; Walter R. A. Goossens; Jan J. J. L. Van Dooren, all of Mol, Belgium

[73] Assignee: Studiecentrum voor Kernenergie, "S.C.K", Brussels, Belgium

[21] Appl. No.: 321,147

[22] Filed: Nov. 13, 1981

[30] Foreign Application Priority Data

Apr. 27, 1980 [BE] Belgium ..... 204615

[51] Int. Cl.[3] ..... C25C 1/22

[52] U.S. Cl. ..... 204/105 R; 204/130; 423/493

[58] Field of Search ..... 204/105 R, 130, 128; 423/43, 46, 493

[56] References Cited

U.S. PATENT DOCUMENTS 3,701,651 10/1972 Hack et al. ..... 204/105 R 4,124,459 11/1978 Blanch et al. ..... 204/105 R

*Primary Examiner*—R. L. Andrews

*Attorney, Agent, or Firm*—Sughrue, Mion, Zinn, Macpeak and Seas

[57] ABSTRACT

There is described a method for separating iodine in solid form, from an acid mercury salt solution, which comprises subjecting said iodine-containing mercury salt solution at a pH value between 2 and 8, at an electrolysis for separating the mercury, and thereafter precipitating from the resulting, substantially mercury-free solution, the iodine in the form of a salt.

10 Claims, 2 Drawing Figures

METHOD FOR SEPARATING IODINE IN SOLID FORM, FROM AN ACID MERCURY SALT SOLUTION

This invention relates to a method for separating iodine in solid form from an acid mercury salt solution, more particularly a mercury nitrate solution such as a mercurex solution. This method is mostly valid for separating radioactive iodine.

Various methods are already known for separating radioactive iodine from an acid mercury salt solution. In such known methods, there is generally formed mercury iodate, either by heating, or by direct hydrolysis as for example according to U.S. Pat. No. 4,162,206.

When on the one hand, use is made of a method according to which the mercury salt, more particularly mercury nitrate solution is heated up to the boiling point, there occurs a volatilizing of a portion from the iodine, which requires recovering again said iodine. On the other hand with the direct electrolysing of a mercury nitrate solution to form mercury iodate, said mercury iodate has to be converted further into barium iodate for example. Such electrolysis has a relatively poor efficiency with low nitric acid concentration, namely in the range of 60% with 1-molar $HNO_3$.

The invention has mainly for object to provide a method which allows to obviate the various drawbacks of such known methods.

For this purpose, the method according to the invention comprises subjecting the iodine-containing mercury salt solution, with a pH value between 2 and 8, to an electrolysis for separating the mercury, ad thereafter precipitating from the resulting, substantially mercury-free solution, the iodine in the form of a salt.

Another important object of the invention lies in strictly minimizing the amount of by-product. For this purpose according to the invention, the method further comprises adding a hydrazine solution as neutralizing agent, to the iodine-containing mercury salt solution to retain the pH value thereof between 2 and 8.

In a particular embodiment of the invention, use is made of a copper salt to precipitate the iodine from the mercury-free solution, in the form of copper iodine.

In a preferred embodiment of the invention, the method comprises adding a $Cu(NO_3)_2$ solution to the mercury-free solution, to precipitate the iodine in the form of CuI.

The invention also relates to an equipment for the working of the above-defined method.

The equipment according to the invention is mainly comprised of an electrolysis cell with a mercury cathode and a platinum or platinum-plated anode, a precipitation tank with stirrer, and a filter, whereby the mercury cathode lies on the cell bottom and connects to a discharge means for draining mercury, and the anode is so mounted above said cathode as to be riemovable along the top side of said cell, and whereby a conveying pipe with pump is provided between the electrolysis cell and the precipitation tank, and between said precipitation tank and the filter.

Other details and features of the invention will stand out from the following description, given by way of non limitative example and with reference to the accompanying drawings, in which.

Figure 2:
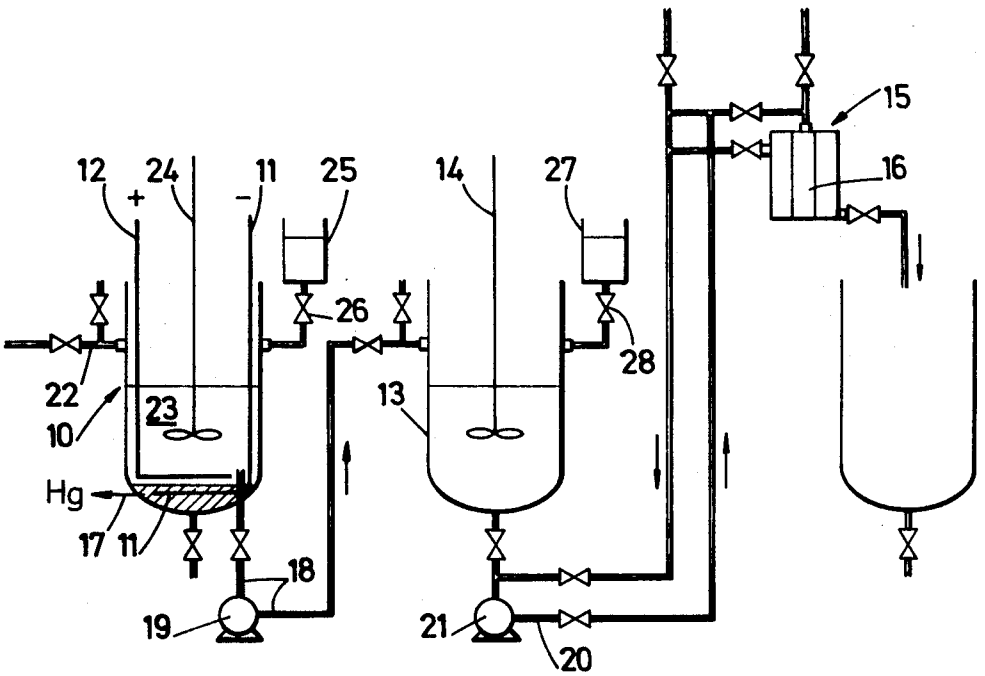
FIG. 2 is a diagrammatic showing of the equipment for the working of the method according to the invention.

The invention relates to a method for recovering iodine from an acid mercury solution, more particularly a mercury nitrate solution, such as a mercurex solution.

Active iodine is formed in the fuel elements from some nuclear reactors; such iodine is mainly released during the dissolving of the fuel as said fuel is treated; and it is volatilized in the discharge gases.

Said discharge gases are consequently treated with said mercury salt solution for retaining the anorganic and organic iodine. Said mercury salt solution, which is generally formed by said mercurex solution, is cycled-back until it is saturated with iodine. Such saturated solution, which thus contains mercury salts and radioactive iodine, is then further treated for the final storage of said active iodine.

According to the invention, said iodine-containing mercury salt solution is subjected at a pH value between 2 and 8, to such an electrolysis that mercury is separated at the cathode and thereafter the iodine is precipitated in the form of a salt from the resulting substantially mercury-free solution.

Said mercurex solution is composed of 1 mole/1 nitric acid and 0.2 to 0.5 mole/1 mercury nitrate. The iodine from the discharge gases is absorbed in the form of iodide in said mercury nitrate solution. For a mercurex solution with a concentration of 0.4 mole/1 mercury nitrate and 1 mole/1 nitric acid, the solubility limit of iodide is 0.06 mole/1, whereby complex ions $HgI^+$ and $HgI_3^+$ are formed (see: Jacimirskij K. B., Sutov A. A., Z. Fiz. Ch., 26,842 (1952)).

Before performing the electrolysis of the acid mercury salt solution, said solution is preferably neutralized to a pH value between 7 and 8, in such a way that after the electrolysis the pH value still remains higher than 2.

To minimize the amount of by-products, use is made of a $N_2H_5OH$ solution as neutralizing agent.

In an advantageous embodiment of the invention, use is made of a copper salt for precipitating the iodine from the mercury-free solution in the form of copper iodide (CuI). The thus-formed precipitate is then filtered and further conditioned to be finally stored.

Said copper salt is preferably added in the form of a $Cu(NO_3)_2$ solution, while the precipitation is performed in slightly acid medium, with a pH value between 1.5 and 4.8. In this relation, it has been determined that there is obtained for iodine a decontaminating factor higher than $10^{+4}$.

The copper iodide suspension may possibly be heated to the boiling point whereby part-agglomerating of the precipitate occurs. This may be of importance when use is made of a filter with relatively large pores. When however use is made of a filter with pores smaller than $20/\mu$ for filtering, this is not required. The size of the precipitate particles always lies between 20 and 40 $\mu$.

Such filtering may advantageously be performed in a vacuum.

An important feature of the invention lies in adding before the electrolysis of the iodine-saturated mercurex solution, a basic reactant for neutralizing thereto, which also takes part in the anodic reaction.

It has indeed been determined that the direct electrolysis of the mercurex solution being used raises very substantial problems and is essentially not possible, due to the two following reasons:

On the one hand, the mercury present as $Hg^{2+}$, $HgI^{+}$, and $Hg_2I^{3+}$, does not follow the expected cathodic reactive pattern:

$$Hg^{2+}+2e^{-}\rightarrow Hg \quad (1)$$

$$HgI^{+}+2e^{-}\rightarrow Hg+I- \quad (2)$$

$$Hg_2I^{3+}+4e^{-}\rightarrow 2\ Hg+I^{31} \quad (3)$$

Instead, $HgI_2$ precipitates, which withstands cathodic reduction;

$$2\ HgI^{+}+2e^{-}\rightarrow Hg+HgI_2\downarrow \quad (4)$$

$$2\ Hg_2^{3+}+6e^{-}\rightarrow 3Hg+HgI_2\downarrow \quad (5)$$

On the other hand, molecular iodine is formed at the anode:

$$2I^{-}\rightarrow I_2+2e^{-}E_o=+0.62\ V \quad (6)$$

Both problems are obviated by adding a neutralising agent, more particularly hydrazine ($N_2H_4.H_2O$; $N_2H_5OH$), until the pH becomes higher than 2. The $Hg^{2+}$ ion is reduced thereby, in part to $Hg_2I_2$:

$$2Hg^{2+}+N_2H_5^{+}\rightarrow 2Hg+N_2+5H^{+} \quad (7)$$

$$4Hg^{2+}+4I^{-}+N_2H_5^{+}\rightarrow 2Hg_2I_2+N_2+5H^{+} \quad (8)$$

During the following electrolysis, the $Hg_2I_2$ precipitate is further reduced:

$$Hg_2I_2+2e^{-}\rightarrow 2Hg+2I^{-} \quad (9)$$

Evidence of the above chemical reduction lies in the number of coulombs being used during the electrolysis being about one fourth of the number theoretically required to reduce all of the $Hg^{2+}$ to Hg. The presence of $N_2H_5^{+}$ ions further results in the following anode reaction:

$$N_2H_5^{+}\rightarrow N_2+5H^{+}+e^{-}E_o=-0.23\ V \quad (10)$$

To prevent completely forming of molecular iodine, the pH has to lie higher than the experimentally-determined value of 1. As the anode reaction results in acidifying the solution, it is required either to add before the electrolysis enough hydrazine, or during such hydrolysis to add continuously hydrazine in such a way that the pH never falls below said value of 2. In both cases, the electrolysis occurs with the same speed.

As material for the anode, use is made of platinum or platinum-plated material (for example titanum). The cathode being used is a mercury cathode. Such a cathode has an overvoltage for hydrogen formation of about 1 V, in such a way that the following cathode reaction is negligible.

$$2H^{+}+2e^{-}\rightarrow H_2 \quad (11)$$

With such an electrolysis method, it is possible to separate mercury from used mercurex solution with an efficiency $\geqq 99.9\%$ $[(Hg^{2+})\leqq 4.10^{-4}]$. Trace inpurities from other metals (Fe, Cr, Ni, Cu, . . . ) have no noticeable influence on this efficiency.

Instead of a $N_2H_5OH$ solution, use could be made for the anode reaction of a $NH_3OH^{+}$ solution. The reaction pattern is then as follows:

$$2NH_3OH^{+}\rightarrow N_2+2H_2O+4H^{+}+2^{-}E_o=-1{,}87\ V.$$

The $NH_3OH^{+}$ is actually only to be obtained as salt, such as $NH_2OH.HCl$, $NH_2OH.H_2SO_4$, $NH_2OH.H_3PO_4$.

To bring the pH value higher than 1 to avoid molecular iodine being formed, a strong base has then to be added, for example NaOH or KOH.

As regards the precipitation which follows the electrolysis, as already mentioned, CuI has been selected as compound for the final conditioning and storage of radioactive iodine. CuI has a solubility product equal to $1.1\times 10^{-12}$. The CuI precipitate is obtained by adding an excess preferably of $Cu(NO_3)_3$ solution to the effluent from the electrolysis step. The following reaction pattern is reckoned:

$$4Cu^{2+}+N_2H_5^{+}\rightarrow 4Cu^{+}+N_2+5H^{+} \quad (12)$$

$$Cu^{+}+I^{-}\rightarrow CuI\downarrow \quad (13)$$

However, as in the electrolysis step, no $N_2H_5OH$ is being used, another reductant may be used, namely a $NH_3OH^{+}$ or $HSO_3^{-}$ solution, with the following reaction pattern:

$$2Cu^{2+}+2NH_3OH^{+}\rightarrow 2Cu^{+}+N_2+2H_2O+H^{+} \text{ or}$$

$$2Cu^{2+}+HSO_3^{-}+H_2O\rightarrow 2Cu^{+}+SO_4^{2-}+3H^{+}$$

Adjusting of the pH value is obtained with a strong acid ($HNO_3$, HCl, $H_2SO_4$), or with a strong base (NaOH, KOH).

When $N_2H_5OH$ is not used, either in the electrolysis step, or in the precipitation step, the result is that the remaining solution which is fed after filtering CuI, to the treatment equipment (4), contains $Na^{+}$, $K^{+}$, $Cl^{-}$, $SO_4^{2-}$ or $PO^{3}4$, depending on the reactant being used.

Figure 1:
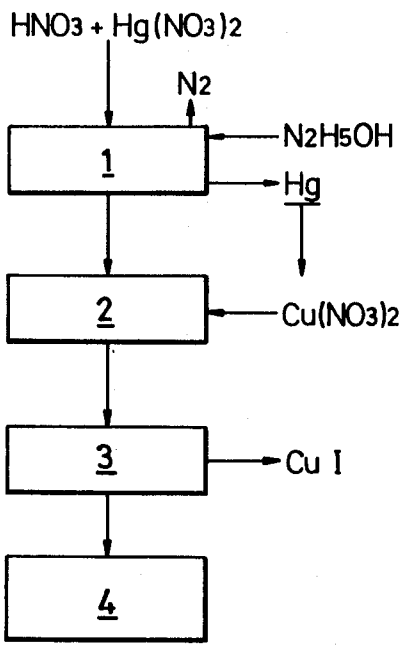
FIG. 1 is a block diagram of the method according to the invention.

The method according to the invention is shown more concretely by the following example wherein reference is made to the block diagram in FIG. 1.

100 liters from an iodine-saturated mercurex solution, with the composition 1 mole/1 $HNO_3$ and 0.4 mole/1 $Hg(NO_3)_2$, is neutralized with 24 liters from a 5-molar hydrazine solution with a pH value 11.6. By adding such an amount hydrazine to the mercurex solution, the pH value thereof is brought between 7 and 7.5.

During a first step (1), mercury is electrolytically precipitated as metal on a mercury cathode.

The molar concentration of this solution after electrolysis was as follows:

$N_2H_5^{+}$: 1.29
$N_2H_4$: 0.097
$NO_3^{-}$: 1.25
$I^{-}$: 0.042

Thereafter during a second step (2), the iodine is precipitated in the mercury-free solution, in the form of CuI by adding to said solution 12 moles or 2,899 g $Cu(NO_3)_2$.

The precipitated CuI is then during a third step (3), filtered out and the remaining solution is discharged to a water-treatment equipment (4).

After filtering the pH of said remaining solution still had a value of 2.2., while the molar concentration thereof was as follows:

$Cu_2^{2+}/Cu^{30}$: 0.04
$N_2H_5^{+}$: 1.31
$NO_3^{-}$: 1.36

In FIG. 2 has been shown a particular embodiment of an equipment for the working of the above-described method.

As the mercurex solution from the wash-column for the iodine-containing exhaust gases is not generally discharged continuously, a "batch" method has no inconvenience for the separating of iodine from the mercurex solution. Consequently it is also for the working of such a discontinuous method that the equipment has been designed in this concrete embodiment.

Said equipment is mainly comprised of an electrolysis cell 10 with a mercury cathode 11 and a platinum or platinum-plated anode 12, followed by a precipitation tank 13 with a stirrer 14, and a vacuum filter 15 with replaceable filter cartridges 16.

The mercury cathode 11 extends substantially horizontally in the lower portion of the cell adjacent the bottom thereof and dips in the mercury. The mercury is drained by means of an outlet 17. The anode 12 extends substantially in parallel relationship above the cathode 11 and it is so mounted as to be removable from the top side of said cell.

A conveying pipe 18 with pump 19 is provided between the cell 10 and the precipitation tank 13, while said tank 13 connects to filter 15 through a similar pipe 20 and pump 21.

To said cell 10 connects a supply line 22 for the mercurex solution 23, which is stirrd inside the cell by means of a stirrer 24.

The neutralising agent is present inside a tank 25 and can be fed manually to the cell at once by opening a valve 26 until a pH value from 7 to 7.5 is reached, in such a way that the pH value after electrolysis reaches 2 to 3. A pH meter is naturally also provided. To remove the electrolysis gases such as nitrogen, the cell is connected to ventilating means not shown.

The precipitation tank 13 can be drained out by means of the pump 21 or under the action of gravity. The copper salt solution is stored in a tank 27 and it is fed manually by means of a valve 28, to the tank 13.

Precipitating may be monitored by an iodine-sensitive electrode, not shown.

A connection to the ventilating means is essential to extract released gases. A heating jacket may possibly be arranged, but this is not absolutely required.

As regards filtering, it has already been stated that vacuum filtering has been selected. As material for the filter cartridges 16, synthetic fibers, ceramics or metal may for example be used.

There is provided for the possibility of drying the CuI after discharge thereof.

It must be understood that the invention is in no way limited to the above embodiments and that many changes can be brought therein without departing from the scope of the invention as defined by the appended claims.

We claim:

1. A method for separating iodine in solid form from a mercury nitrate solution, which comprises subjecting the iodine-containing mercury salt solution, with a pH value between 2 and 8, to an electrolysis (1) for separating the mercury, and thereafter precipitating (2) from the resulting, substantially mercury-free solution, the iodine in the form of a salt.

2. Method as defined in claim 1, in which before the electrolysis (1), the pH value of the iodine-containing mercury salt solution is brought between 7 and 8, in such a way that after said electrolysis the pH value still remains higher than 2.

3. Method as defined in claim 1, in which a $N_2H_5OH$ solution is added before the electrolysis as neutralising agent to retain the pH value of the mercury salt solution between 2 and 8.

4. Method as defined in claim 1, in which use is made during said electrolysis (1), of a platinum or platinum-plated anode and a mercury cathode.

5. Method as defined in claim 1, in which use is made of a copper salt for precipitating the iodine from the mercury-free solution in the form of copper iodide (CuI).

6. Method as defined in claim 5, in which a $Cu(NO_3)_2$ solution is added to the mercury-free solution for precipitating the iodine in the form of CuI.

7. Method as defined in claim 6, in which the precipitating is performed at a pH value between 1.5 and 4.8.

8. Method as defined in claim 1, in which the suspension obtained due to precipitating of the iodine, is heated up to the boiling point, in such a way that the precipitate partly agglomerates.

9. Method as defined in claim 1, in which the precipitate is separated from the iodine salt by filtering.

10. Method as defined in claim 9, in which the precipitate is separated by vacuum filtering.

* * * * *